US005609533A

United States Patent [19]

Wheeler

[11] Patent Number: 5,609,533

[45] Date of Patent: Mar. 11, 1997

[54] BALL MARK REMOVER TOOL

[76] Inventor: Robert A. Wheeler, 5075 Carnoustie Dr., Reno, Nev. 89502

[21] Appl. No.: 568,401

[22] Filed: Dec. 15, 1995

Related U.S. Application Data

[63] Continuation-in-part of Ser. No. 349,874, Dec. 6, 1994.

[51] Int. Cl.[6] ..... A63B 57/00

[52] U.S. Cl. ..... 473/408; 473/406

[58] Field of Search ..... 473/406, 408

[56] References Cited

U.S. PATENT DOCUMENTS

| | | | |
|---|---|---|---|
| 3,539,017 | 11/1970 | Johnson | 473/408 X |
| 3,622,157 | 11/1971 | Hatch | 273/32 A |
| 4,151,937 | 5/1979 | Jarosh et al. | 473/408 X |
| 4,787,632 | 11/1988 | Nigrelli et al. | 273/32 B |
| 4,884,805 | 12/1989 | Patterson | 273/32 B |
| 4,960,239 | 10/1990 | Wait | 273/32 B |
| 4,960,278 | 10/1990 | Hainey | 273/32 B |
| 4,984,790 | 1/1991 | Dowdy et al. | 273/32 B |
| 5,022,650 | 6/1991 | Madock | 273/32 A |
| 5,110,123 | 5/1992 | Larson | 273/32 A |
| 5,160,134 | 11/1992 | McDonald | 273/32 B |
| 5,209,469 | 5/1993 | Laskowitz et al. | 237/32 B |
| 5,211,395 | 5/1993 | Liao | 273/32 A |
| 5,224,700 | 7/1993 | Rosen | 473/408 |
| 5,226,647 | 7/1993 | Notarmuzi | 273/32 B |

FOREIGN PATENT DOCUMENTS

| | | |
|---|---|---|
| 531217 | 5/1993 | Japan . |
| 247179A | 2/1992 | United Kingdom . |

*Primary Examiner*—William H. Grieb
*Attorney, Agent, or Firm*—Christie, Parker & Hale, LLP

[57] ABSTRACT

A tool for use in the game of golf, comprised of a polygonal prongs along with a radiused edge, which is used to remove ball marks such as indentions and ridges from golf ground surfaces. These ball marks are formed when the ball impacts the ground surface. The tool additionally incorporates a case for the carrying of small objects. These small objects include a moistened sponge or similar material to clean golf balls or club heads. A substantially leak-proof engagement between the body and the cover of the case allows the sponge or similar material to remain moist over extended periods of time, thus prolonging the material's cleaning capability.

13 Claims, 3 Drawing Sheets

BALL MARK REMOVER TOOL

CROSS-REFERENCE TO RELATED APPLICATION

This is a continuation-in-part of application Ser. No. 08/349,874, filed Dec. 6, 1994.

FIELD OF THE INVENTION

The present invention relates generally to the field of tools and devices used in connection with the game of golf. In particular, the invention provides a combined ball mark repair tool and case configuration adapted for repairing the ball marks.

BACKGROUND OF THE INVENTION

The game of golf involves hitting a ball with a club. The ball often damages the surface it lands on. When the ball hits the ground, it causes a depression on the surface. As the surface is being depressed, most of the ground underneath the surface gets displaced. Some of it, however, gets compacted. The displaced ground typically forms a ridge around the depressed surface. The ridge extends beyond the ground surface level. This ridge and depression area is referred to as a "ball mark."

Current practice is to use a ball mark remover tool, often similar to a two pronged fork, to remove the indentations caused by the ball. In removing the ball marks the tool is inserted into the ground close to the ball mark, and at an angle such that the prongs extend underneath the ballmark. Pressure is then exerted against the tool so that the forward edge of the prongs rise, raising the ball mark so that it disappears from the golf green surface.

The removal of ball marks in this manner often causes an additional small ridge to be formed on the surface between the insertion point and the location of the ballmark, and such ridges disturb the smooth surface of the golf green. Nigrelli et al., U.S. Pat. No. 4,787,632; Patterson U.S. Pat. No. 4,884,805; Dowly et al. U.S. Pat,. No.4,984,790; and Laskowitz U.S. Pat. No. 5,209,469 disclose improvements to ball mark repair tools, but do not address the above problem. Nor is a tool disclosed by the prior art with a radiused edge for removing a ridge, caused by ball impact, by "kneading" the ridge back to level ground. The disclosed tools have relatively flat edges which are not designed for kneading ground ridges back to ground level.

The radiused edge embodied in the present invention allows for kneading of the ridge back to ground while displacing the ground underneath the ridge to elevate the depressed area resulting in minor ground compaction. As the radiused surface of the edge is pressed against the ridge, it initially makes contact at a line along the surface length. As the radiused surface is pushed further, the area of contact with the ridge gradually increases. This gradual increase in the area of contact causes the ground underneath the ridge to be gradually displaced resulting in minor ground compaction.

Use of other edge surfaces for kneading a ridge, on the other hand, results in ground compaction with minor ground displacement. Compaction prevents the ground material from being displaced to the depressed ball mark area. Therefore, the ball mark cannot be repaired. A surface with a sharp edge, for example, would cause an indentation on the ground, resulting in ground compaction. This is so, because all of the force being applied to the tool is concentrated on the sharp edge making contact with the ground, rather than being spread over a wider area. If a flat edge surface is used, the same problem occurs if the flat surface is not parallel with the ground when making contact during the kneading process. Otherwise, the edge formed by the intersection of the side and edge surface of the tool would make contact with the ground first, resulting in the same problems faced with a sharp edge surface discussed above. In other words, with a flat edge surface the user must ensure that the edge surface always remains parallel to the ground. This results in a great inconvenience to the user because it limits the angle at which the prongs may be inserted into the ground, often preventing the prongs from reaching the ground material underneath the depression. This problem is alleviated with use of a radiused edge, because the user can insert the prongs at a plurality of angles while ensuring contact with the curved portion of the surface. This allows the prongs to be inserted into the ridge at the various angles necessary to reach the material underneath the depressed area of the ball mark. Furthermore, even if the flat surface is parallel to the ground surface when it makes contact,. compaction of the ground kneaded may still occur. A flat surface, unlike a radiused surface, makes complete contact with the ground from the contact onset, thereby not providing for a gradual increase in contact area during the kneading process which fosters ground displacement.

Another feature of the present invention not disclosed by the prior art is a small enclosed case as part of the small golf tool. This small enclosed case which is preferably well sealed can be used to store different small articles needed in the game of golf. Currently, moistened pieces of cloth are used in the game of golf to aid in cleaning golf balls. These pieces of cloth are typically exposed to air which dries them out decreasing their cleaning capabilities. By storing these moistened pieces of cloth in the sealed case, they are able to remain moist for longer periods of time prolonging their useful life. Hatch U.S. Pat. No. 3,622,157; Wait U.S. Pat. No. 4,960,239; Hainey U.S. Pat. No. 4,960,278; Madock U.S. Pat. No. 5,022,650; Larson U.S. Pat. No. 5,110,123; McDonald U.S. Pat. No. 5,160,134; Liao U.S. Pat. No. 5,211,395; Notarmuzi U.S. Pat. No. 5,226,647; Great Britain 2,247,179A; and Japan 5-31217 all disclose ball mark remover tools to which various items may be attached. However, none disclose a small enclosed case.

BRIEF SUMMARY OF THE INVENTION

There is provided in practice of this invention, according to a preferred embodiment, a tool comprising a substantially polygonal body having a case and a cover, a radiused edge, and a set of prongs extending from the body (case or cover) in the direction of the radiused edge proximate and substantially parallel to a side of the case and substantially perpendicular to the radiused edge. The radiused edge has a substantially circular shape. The tool is employed by using the prongs along with the radiused edge to repair a golf green by repeatedly poking at the ridge formed by ball impact so that the radiused edge pushes against the ridge until the ball mark is removed. An alternative embodiment of the invention, employs a second radius on the edge proximate the prongs wherein the second radius is substantially orthogonal to the first radius. The combination of the second radius orthogonal to the first radius enhances the ability of the tool to tamp the sod in removing the ball mark without creating secondary ridges in the surface of the green due to use of the tool.

The body is used in various embodiments to encapsulate and securely carry small items. Exemplary of such an item is a small piece of moist material suitable for cleaning golf balls and club heads, such as a sponge. A substantially leak-proof engagement between the body of the case and the cover of the case allows the case to efficiently retain moisture, increasing the capability of the moist material to clean over time.

BRIEF DESCRIPTION OF THE DRAWINGS

These and other features of this invention are more fully set forth in the following description of an embodiment of the invention. The description is presented with reference to the accompanying drawings of which.

DETAILED DESCRIPTION

Figure 1:
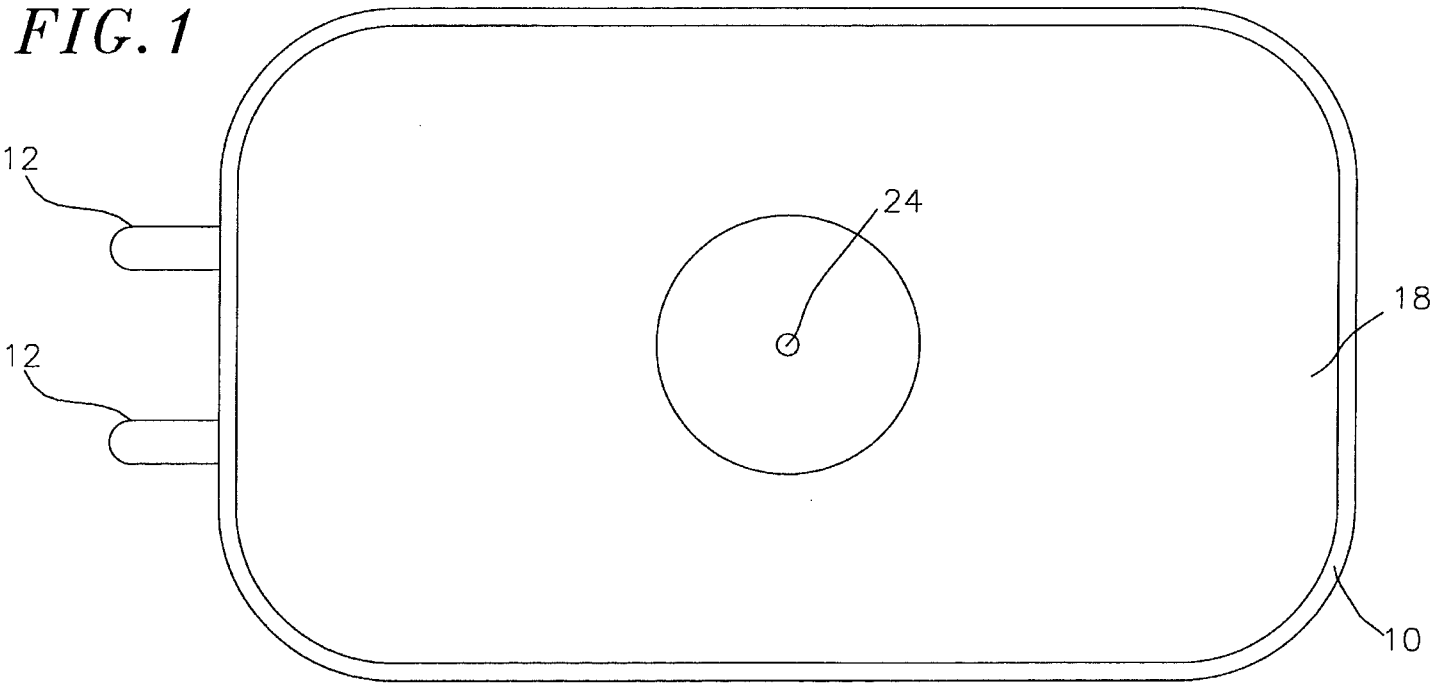
FIG. 1 is a top view of an embodiment showing the body of the case, two prongs extending from the case, and a golf ball marker attached to the top of the case.
Figure 2:
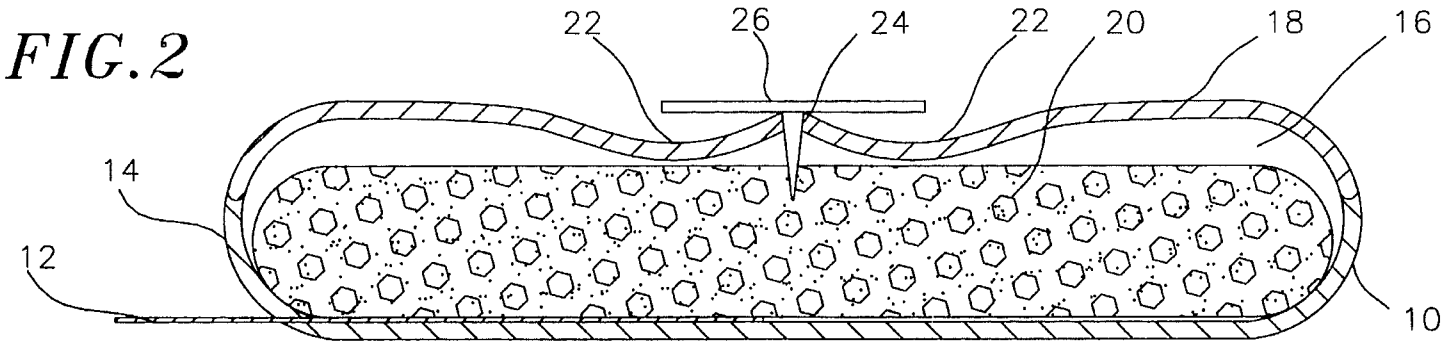
FIG. 2 is a cut-away side view of the embodiment shown in FIG. 1 showing the radiused edge, the placement of the prongs relative to the radiused edge, the cleaning material contained within the case, and the ball marker attached to the case.

The present invention provides an improved golf green repair tool and carrying case. In a preferred embodiment shown in the drawings, the tool comprises a body having a case 10 and a cover 18, a radiused edge 14, and two prongs 12 extending from the case. The edge is the surface connecting the upper and lower sides of the body. The body in alternate embodiments has an oblong, semi-circular, triangular, or other substantially polygonal shape. The prongs in alternate embodiments are an inherent part of the body (case or cover) or they may be separately manufactured and bonded, screwed into, or otherwise attached to the body. The prongs are positioned so that they extend in the direction of the radiused edge from an area on the case proximate and substantially parallel to a side of the case and perpendicular to the radiused edge. The radiused edge has a substantially semi-circular shape.

The purpose of the prongs is to aerate and loosen the ground, especially areas of compaction due to ball impact. The radiused edge is used to knead the ridge back into level ground. To remove a ball mark, the ridge is poked repeatedly with the prongs as the tool is pushed into the ground until the radiused edge pushes against the ridge. The tool may be inserted into the ridge at an angle so that the prongs extend underneath the depressed area loosening any compaction that may have occurred. By repeating this process, in essence, the radiused edge kneads the ridge into the ground causing the ground material underneath the ridge to shift towards the now loosen material beneath the depressed area displacing the depressed area upwards.

The case incorporates an inner chamber 16, which is formed by the case 10 closed through the use of the cover 18. The cover may engage the case in alternate embodiments by means of a lip extending from the inner wall of the cover which is mated to a recess on the inner wall of the case, or by means of a hinge attaching one edge of the cover to one edge of the case and a latching mechanism on the opposite side of the cover and case.

In the embodiment shown, a sponge 20 or other material is fitted for engagement with the lower half of the case. Indentations 22, on the top of the case and proximate an opening incorporated in the top of the case 24, are used as finger or thumb holds. The indentations provide space to aid in removing a ball marker 26, whose stem is attached to the case via the opening incorporated in the case.

Figure 3:
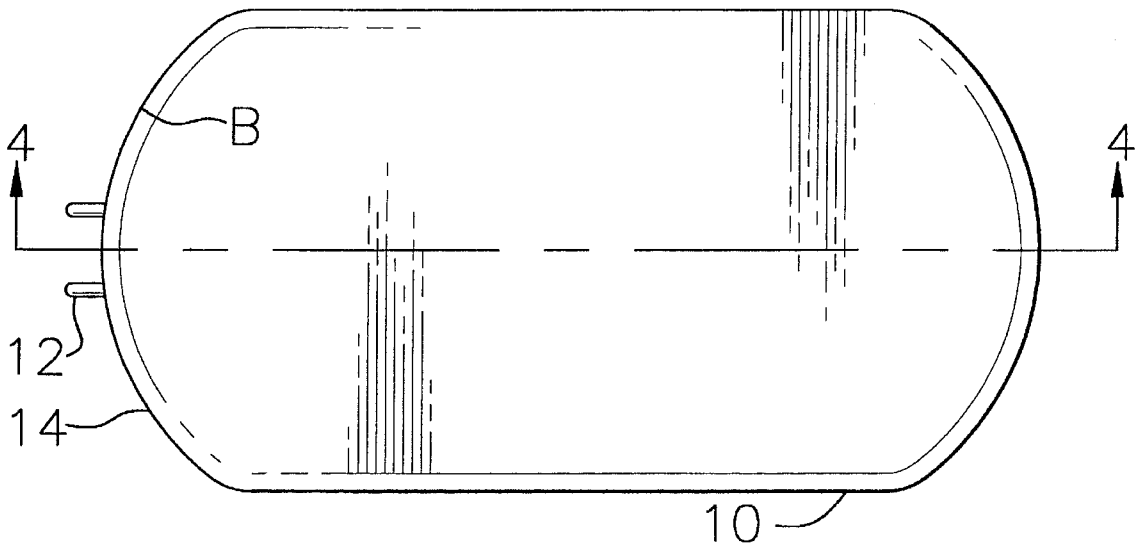
FIG. 3 is a top view of an alternative embodiment of the present invention, showing the body of the case having a second radius on the edge proximate the prongs extending from the case.
Figure 4:
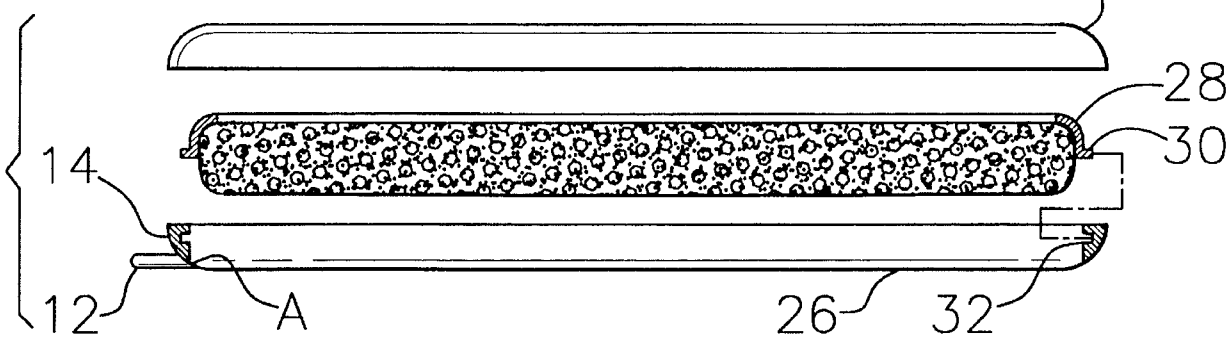
FIG.4 is an exploded sectional side view of the tool shown in FIG. 3 demonstrating a sponge retainer ring for constraining the sponge within the case.

An alternative embodiment of the present invention is shown in FIGS. 3–6. FIGS. 3 and 4 show an embodiment of the invention wherein the body of the tool incorporates a case 10 and cover 18 as previously described. The operative radiused edge 14, proximate the prongs 12 not only incorporates a radius extending upward from the side of the case 26 as best seen in FIG. 4 but also incorporates a second radius as best seen in FIG. 3 which is orthogonal to the first radius at all points on edge 14. The dual radius on edge 14 creates a surface having a complex curvature which enhances the tamping function of the tool. The dual curvature of the edge proximate the prongs avoids the creation of secondary ridging in the turf of the green during removal of ball marks.

The second embodiment of the invention as shown in FIG. 4 incorporates a sponge retainer ring 28 which is adapted to be received over the sponge and incorporates tangs 30 which are received in indentations 32 in the interior of the case to retain the sponge in the case if the cover is removed and the case is intentionally or inadvertently inverted.

Figure 5:
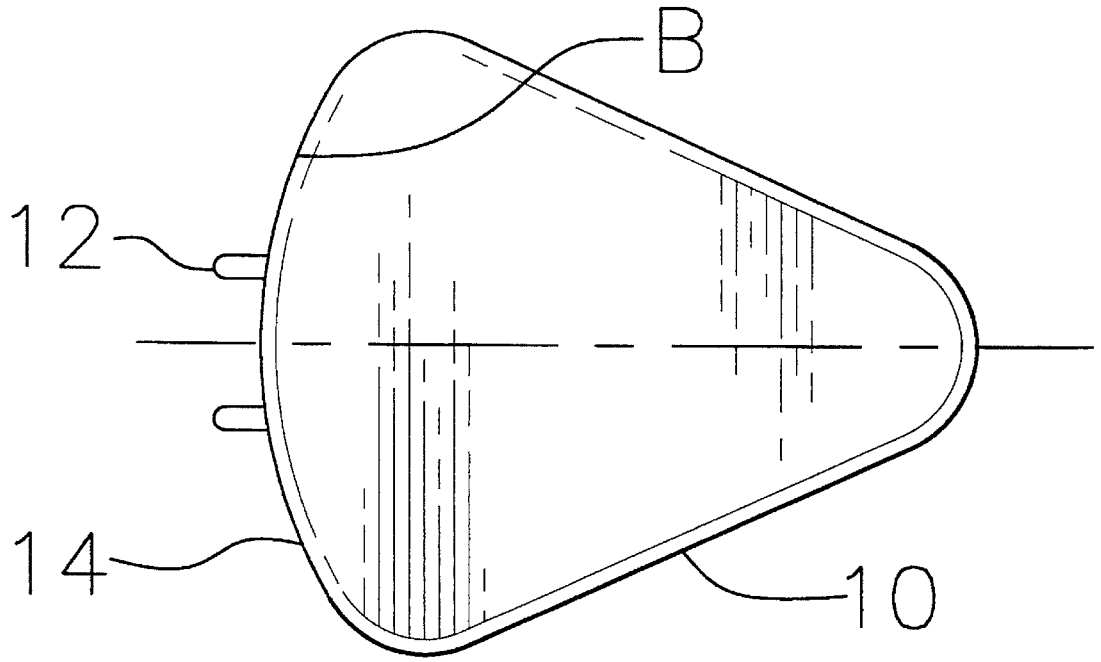
FIG. 5 is a top view of an embodiment of the invention employing a solid body with an edge proximate the prongs, having the dual orthogonal radius.
Figure 6:
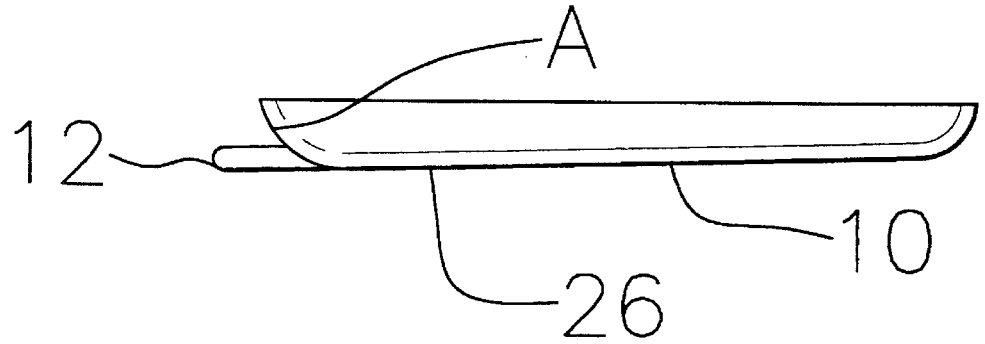
FIG. 6 is a side view of the embodiment of the tool shown in FIG. 5.

FIGS. 5 and 6 disclose an embodiment of the present invention employing a solid body having a truncated triangular shape easily grasped by the user. The operative edge 14 proximate prongs 12 again employs a first radius generally designated A between the top and bottom sides of the tool and a second radius generally designated B extending between the left and right sides of the tool. Radius B is substantially orthogonal to radius A at all points on edge 14 creating a complex curved surface.

Having now described the invention in detail, as required by the patent statutes, those skilled in the art will recognize modifications and substitutions to the elements of the invention disclosed herein. Such modifications and substitutions are within the scope and intent of the invention as defined in the following claims.

What is claimed is:

1. A tool for use in the game of golf comprising a substantially polygonal body having a radiused edge wherein said polygonal body comprises:

a case and a cover forming a substantially leak proof enclosed chamber to accommodate moistened material;

an opening to accommodate a ball marker;

a single or a plurality of indentations in said substantially polygonal body proximate to the opening, each indentation spans and extends beyond an area of the body to be covered by the ball marker; and a plurality of prongs extending in the direction of the radiused edge proximate and substantially parallel to a side of said substantially polygonal body and substantially perpendicular to said radiused edge.

2. A tool for use in the game of golf comprising:

a substantially polygonal body having a radiused edge and comprising a case and a cover engaging said case thereby providing an enclosed chamber, said case and said cover having substantially leak-proof engagement, and said chamber containing a moistened material suitable for cleaning gulf balls or club heads; and a plurality of prongs extending in the direction of the radiused edge proximate and substantially parallel to a side of said substantially polygonal body and perpendicular to said radiused edge.

3. The tool of claim 2, wherein said moistened material suitable for cleaning golf balls or club heads is a sponge fitted for engagement within said case body.

4. A tool for use in the game of golf comprising:

a substantially polygonal body having a radiused edge and incorporating a means for attaching a ball marker thereto which includes an opening to accommodate the ball marker proximate a single or a plurality of indentations wherein each indentation spans and extends beyond an area of the body to be covered by the ballmarker when attached; and a plurality of prongs extending in the direction of the radiused edge proximate and substantially parallel to a side of said substantial polygonal body and perpendicular to said radiused edge.

5. A tool for use in the game of golf comprising:

a body consisting of a substantially polygonal case and a cover forming a radiused edge, said polygonal case incorporating a means for attaching a ball marker comprising an opening to accommodate the ball marker proximate a single or a plurality of indentations wherein each indentation spans and extends beyond an area of the body to be covered by the ball marker when attached; and a plurality of prongs extending in the direction of the radiused edge proximate and substantially parallel to a side of the case substantially perpendicular to said edge.

6. The tool of claim 5, wherein there is a substantially leak-proof engagement between said case and said cover, forming a chamber to contain a moistened material suitable for cleaning golf balls and clubs heads.

7. The tool of claim 6, wherein said moistened material suitable for cleaning golf balls and club heads is a sponge fitted for engagement within said case body.

8. A tool for the game of golf comprising:

a body of material with two substantially parallel surfaces, and an edge surface, comprising a radiused portion connecting said substantially parallel surfaces, said body of material consisting of a case and a cover adapted to engage said case thereby providing an enclosed chamber, said case and said cover having substantially leak-proof engagement, and said chamber containing a moistened material suitable for cleaning golf balls or club heads; and a plurality of prongs extending in the direction of the edge surface proximate and substantially parallel to one of said substantially parallel surfaces and substantially perpendicular to the edge surface.

9. The tool of claim 8, wherein said moistened material suitable for cleaning golf balls or club heads is a sponge fitted for engagement within said case body.

10. The tool of claim 8, wherein said means for attaching a ball marker to said body of material is an opening to accommodate the ball marker proximate a single or a plurality of indentations wherein each indentation spans and extends beyond an area of the body to be covered by the ball marker when attached.

11. A tool for the game of golf comprising:

a body of material with two substantially parallel surfaces, and an edge surface connecting said substantially parallel surfaces wherein the edge surface incorporates a first radius extending from one parallel surface to the other and a second radius substantially orthogonal to the first radius, said second radius extending substantially continuously from a right side to a left side of the body; and a plurality of prongs extending in the direction of the edge surface proximate and substantially parallel to one of said substantially parallel surfaces and substantially perpendicular to the edge surface.

12. A tool for the game of golf comprising:

a body of material with two substantially parallel surfaces, and an edge surface connecting said substantially parallel surfaces wherein the edge surface incorporates a first radius extending from one parallel surface to the other and a second radius substantially orthogonal to the first radius; and a plurality of prongs extending in the direction of the edge surface proximate and substantially parallel to one of said substantially parallel surfaces and substantially perpendicular to the edge surface; the body of material comprising a case and a cover adapted to engage said case thereby providing an enclosed chamber, said case and said cover having substantially leak proof engagement, and said chamber containing a moistened material suitable for cleaning golf balls or golf club heads.

13. A tool for the game of golf as defined in claim 12 wherein an interior surface of the case incorporates a circumferential indentation and said moistened material comprises a sponge, and further comprising a retainer ring adapted to be received inside the case and engage the sponge said retaining ring incorporating a prong adapted to engage the indentation in the case, said ring restraining the sponge in the case when so engaged.

* * * * *